US006736117B2

(12) United States Patent
Isobe et al.

(10) Patent No.: US 6,736,117 B2
(45) Date of Patent: May 18, 2004

(54) ABNORMALITY DETECTING DEVICE FOR EVAPORATIVE FUEL PROCESSING SYSTEM

(75) Inventors: Takashi Isobe, Wako (JP); Satoshi Kiso, Tochigi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 45 days.

(21) Appl. No.: 10/166,385

(22) Filed: Jun. 11, 2002

(65) Prior Publication Data

US 2002/0184942 A1 Dec. 12, 2002

(30) Foreign Application Priority Data

Jun. 12, 2001 (JP) ..... 2001-176733

(51) Int. Cl.[7] ..... F02M 33/04
(52) U.S. Cl. ..... 123/520
(58) Field of Search ..... 123/519, 518, 123/520, 198 D

(56) References Cited

U.S. PATENT DOCUMENTS 5,494,021 A * 2/1996 Yoneyama ..... 123/520
5,592,923 A * 1/1997 Machida ..... 123/520
5,732,687 A * 3/1998 Hashimoto et al. ..... 123/520
5,746,191 A * 5/1998 Isobe et al. ..... 123/520
5,765,539 A * 6/1998 Isobe et al. ..... 123/520
5,767,395 A * 6/1998 Goto et al. ..... 123/520
5,775,307 A * 7/1998 Isobe et al. ..... 123/520
6,227,037 B1 * 5/2001 Kawamura et al. ..... 123/520

FOREIGN PATENT DOCUMENTS

JP 2857656 12/1998

* cited by examiner

*Primary Examiner*—Thomas N. Moulis
(74) *Attorney, Agent, or Firm*—Arent Fox, PLLC

(57) ABSTRACT

An abnormality detecting device for an evaporative fuel processing system is disclosed. The evaporative fuel processing system includes a fuel tank, a canister for trapping evaporative fuel generated in the fuel tank, a charging passage for connecting the fuel tank and the canister, an on-off valve provided in the charging passage for opening and closing the charging passage, and a pressure sensor provided in the charging passage at a position between the on-off valve and the fuel tank. A pressure in the canister is reduced to a pressure which is lower than the atmospheric pressure in the condition where the on-off valve is open. The on-off valve is closed at the time of completion of the pressure reduction, and it is determined that the charging passage is clogged between the pressure sensor and the fuel tank, when an amount of change in pressure detected by the pressure sensor is less than a predetermined change amount after closing the on-off valve.

15 Claims, 9 Drawing Sheets

OPEN-TO-ATMOSPHERE
SHORT PRESSURE REDUCTION
CLOGGING CHECK
FIG. 8A PCV
DUTY
CLOSE
FIG. 8B BPV
OPEN
CLOSE
FIG. 8C VSV
OPEN
CLOSE
FIG. 8D PTANK
ATMOSPHERIC PRESSURE
P1
P2
P3
P1F
P2F
P3F
TLKDYS
TPTLKS

ABNORMALITY DETECTING DEVICE FOR EVAPORATIVE FUEL PROCESSING SYSTEM

BACKGROUND OF THE INVENTION

The present invention relates to an abnormality detecting device for an evaporative fuel processing system for processing evaporative fuel generated in a fuel tank containing fuel to be supplied to an internal combustion engine.

An abnormality detecting device for determining an abnormality in an evaporative fuel processing system is known from Japanese Patent No. 2857656, for example. In this conventional abnormality detecting device, a negative pressure (a pressure lower than the atmospheric pressure) generated in an intake pipe of an internal combustion engine is introduced into the evaporative fuel processing system to reduce the pressure in the evaporative fuel processing system, and the abnormality in the evaporative fuel processing system is determined according to the pressure in this system after the above pressure reduction. The evaporative fuel processing system includes a fuel tank, a canister for temporarily storing evaporative fuel generated in the fuel tank, and a charging passage for connecting the fuel tank and the canister.

According to the above abnormality detecting device, a leak in the fuel tank or the canister can be detected. However, a failure such that the charging passage is clogged cannot be detected.

SUMMARY OF THE INVENTION

It is accordingly an object of the present invention to provide an abnormality detecting device for an evaporative fuel processing system which can detect the clogging failure of the charging passage for connecting the fuel tank and the canister.

In order to attain the above object, the present invention provides an abnormality detecting device for an evaporative fuel processing system. The evaporative fuel processing system includes a fuel tank (9), a canister (33) for trapping evaporative fuel generated in the fuel tank (9), a charging passage (31) for connecting the fuel tank (9) and the canister (33), an on-off valve (36) provided in the charging passage (31) for opening and closing the charging passage (31), and a pressure sensor (15) provided in the charging passage at a position between the on-off valve (36) and the fuel tank (9). The abnormality detecting device includes pressure reducing means and clogging determining means. The pressure reducing means reduces a pressure in the canister (33) to a pressure which is lower than the atmospheric pressure in the condition where the on-off valve (36) is open. The clogging determining means closes the on-off valve (36) at the time of completion of the pressure reduction by the pressure reducing means, and determines that the charging passage (31) is clogged between the pressure sensor (15) and the fuel tank (9), when the amount of change (PTANK–PTGROSLK) in the pressure detected by the pressure sensor is less than a predetermined change amount (DPT2WYOK) after closing the on-off valve.

With this configuration, the pressure in the canister is reduced to a pressure which is lower than the atmospheric pressure in the condition where the on-off valve provided in the charging passage is open, and the on-off valve is next closed at the time of completion of this pressure reduction. Further, when the amount of change in the pressure detected by the pressure sensor after closing the on-off valve is less than the predetermined change amount, it is determined that the charging passage is clogged between the pressure sensor and the fuel tank. If the charging passage is normal, the closing of the on-off valve results in an increase in the pressure detected by the pressure sensor, because the pressure in a portion of the charging passage between the on-off valve and the fuel tank and the pressure in the fuel tank are averaged. In contrast, if the charging passage is clogged between the pressure sensor and the fuel tank, the pressure detected by the pressure sensor is held at the reduced pressure also after closing the on-off valve. Accordingly, when the pressure change amount after closing the on-off valve is less than the predetermined change amount, it can be determined that the charging passage is clogged.

Preferably, the pressure reducing means completes the pressure reduction in a short time period (TSDEC2, e.g., 3–5 seconds) so that a pressure in the charging passage may be reduced to a predetermined pressure (PDEC2) which is lower than the atmospheric pressure.

If the pressure reduction is executed for a long period, the pressure in the fuel tank decreases, which reduces determination accuracy. Therefore, by completing the pressure reduction in a relatively short time period, the pressure decrease in the fuel tank is substantially prevented so that good determination accuracy can be obtained.

Preferably, the clogging determining means executes the determination of clogging of the charging passage (31) after confirming no occurrence of a failure that the on-off valve (36) remains open and does not close in spite of being supplied with a valve closing command signal.

Preferably, the clogging determining means determines that the charging passage (31) is clogged between the pressure sensor (15) and the fuel tank (9), when the condition where the amount (PTANK–PTGROSLK) of change in the pressure detected by the pressure sensor (15) is less than the predetermined change amount (DPT2WYOK), continues over a predetermined time period (TPTLKS) or more.

Preferably, the clogging determining means determines that the charging passage (31) is clogged between the pressure sensor (15) and the fuel tank (9), when the pressure (PTLK0) detected by the pressure sensor (15) after closing the on-off valve (36) is lower than a predetermined pressure (PT2WYOK) which is lower than the atmospheric pressure, and the amount (PTANK–PTGROSLK) of change in the pressure detected by the pressure sensor is less than the predetermined change amount (DPT2WYOK).

DETAILED DESCRIPTION OF THE PREFERRED EMBODIMENTS

A preferred embodiment of the present invention will now be described with reference to the drawings.

Figure 1:
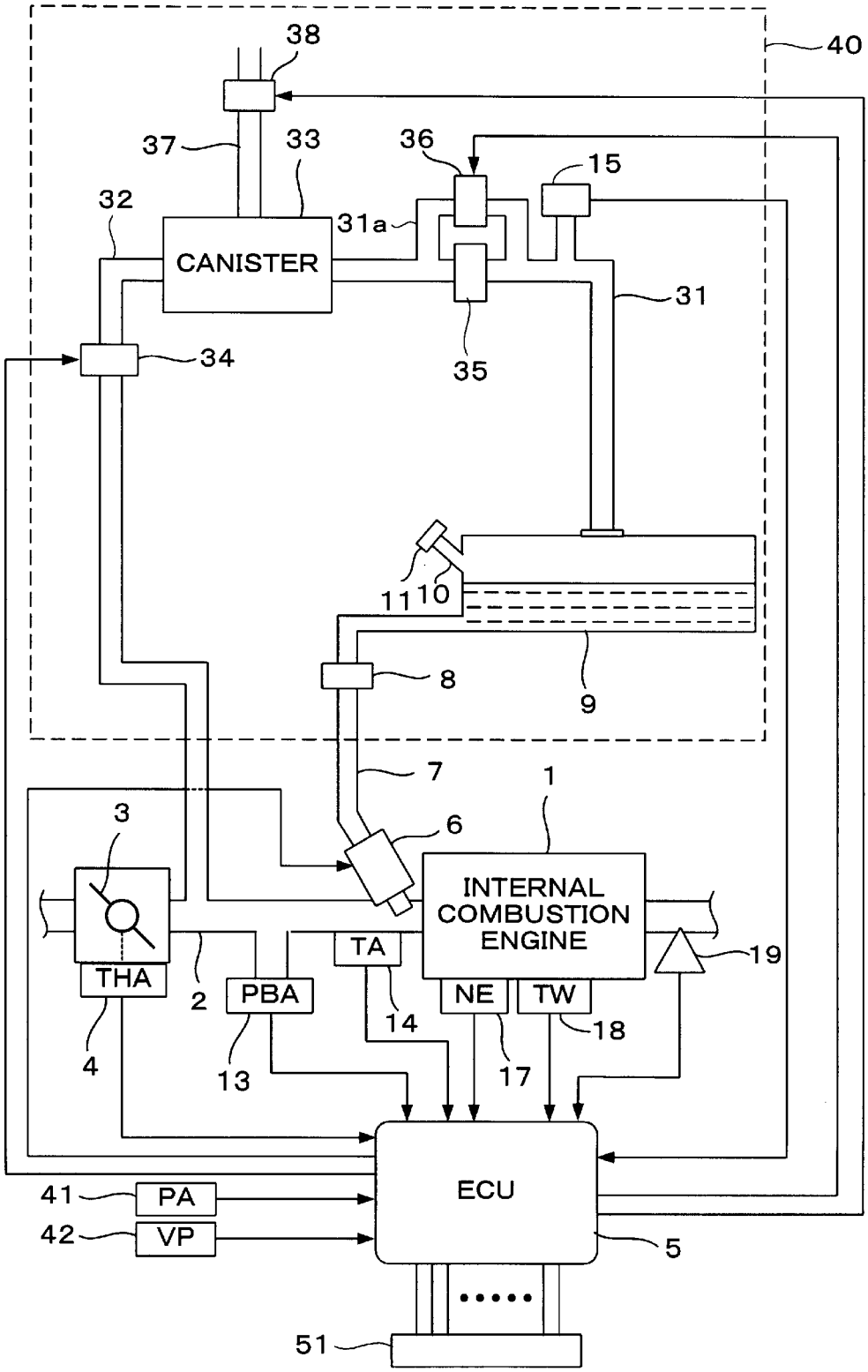
FIG. 1 is a schematic diagram showing the configuration of an evaporative fuel processing system and a control system for an internal combustion engine according to a preferred embodiment of the present invention.

FIG. 1 is a schematic diagram showing the configuration of an evaporative fuel processing system and a control system for an internal combustion engine according to a preferred embodiment of the present invention. Referring to FIG. 1, reference numeral 1 denotes an internal combustion engine (which will be hereinafter referred to simply as "engine") having a plurality of (e.g., four) cylinders. The engine 1 is provided with an intake pipe 2, in which a throttle valve 3 is mounted. A throttle valve opening (THA) sensor 4 is connected to the throttle valve 3. The throttle valve opening sensor 4 outputs an electrical signal corresponding to the opening angle of the throttle valve 3 and supplies the electrical signal to an electronic control unit (which will be hereinafter referred to as "ECU") 5 for controlling the engine 1.

Fuel injection valves 6, only one of which is shown, are inserted into the intake pipe 2 at locations intermediate between the cylinder block of the engine 1 and the throttle valve 3 and slightly upstream of the respective intake valves (not shown). The fuel injection valves 6 are connected via a fuel supply pipe 7 to a fuel tank 9. The fuel supply pipe 7 is provided with a fuel pump 8. The fuel tank 9 has a fuel inlet 10 for use in refueling, and a filler cap 11 is mounted on the fuel inlet 10.

Each fuel injection valve 6 is electrically connected to the ECU 5, and its valve opening period is controlled by a signal from the ECU 5. The intake pipe 2 is provided with an intake pipe absolute pressure (PBA) sensor 13 for detecting an absolute pressure PBA in the intake pipe 2 and an intake air temperature (TA) sensor 14 for detecting an air temperature TA (ambient temperature) in the intake pipe 2 at positions downstream of the throttle valve 3.

An engine rotational speed (NE) sensor 17 for detecting an engine rotational speed is disposed near the outer periphery of a camshaft or a crankshaft (both not shown) of the engine 1. The engine rotational speed sensor 17 outputs a pulse (TDC signal pulse) at a given crank angle per 180° rotation of the crankshaft of the engine 1. There are also provided an engine coolant temperature sensor 18 for detecting a coolant temperature TW of the engine 1 and an oxygen concentration sensor (which will be hereinafter referred to as "LAF sensor") 19 for detecting an oxygen concentration in exhaust gases from the engine 1. Detection signals from these sensors 13 to 19 are supplied to the ECU 5. The LAF sensor 19 functions as a wide-region air-fuel ratio sensor which outputs a signal substantially proportional to an oxygen concentration in exhaust gases (proportional to an air-fuel ratio of air-fuel mixture supplied to the engine 1).

An atmospheric pressure sensor 41 for detecting an atmospheric pressure PA and a vehicle speed sensor 42 for detecting a running speed (vehicle speed) VP of a vehicle on which the engine 1 is mounted are also connected to the ECU 5, and detection signals from these sensors 41 and 42 are supplied to the ECU 5.

The fuel tank 9 is connected through a charging passage 31 to a canister 33. The canister 33 is connected through a purging passage 32 to the intake pipe 2 at a position downstream of the throttle valve 3.

The charging passage 31 is provided with a two-way valve 35. The two-way valve 35 consists of a positive-pressure valve and a negative pressure valve. The positive pressure valve opens when the pressure in the fuel tank 9 is higher than the atmospheric pressure by a first predetermined pressure (e.g., 2.7 kPa (20 mmHg)) or more. The negative-pressure valve opens when the pressure in the fuel tank 9 is lower than the pressure in the canister 33 by a second predetermined pressure or more.

The charging passage 31 is branched to form a bypass passage 31*a* bypassing the two-way valve 35. The bypass passage 31*a* is provided with a bypass valve (on-off valve) 36. The bypass valve 36 is a normally closed solenoid valve, which is opened and closed during execution of abnormality diagnosis to be hereinafter described. The operation of the bypass valve 36 is controlled by the ECU 5.

The charging passage 31 is further provided with a pressure sensor 15 at a position between the two-way valve 35 and the fuel tank 9. A detection signal output from the pressure sensor 15 is supplied to the ECU 5. The output PTANK from the pressure sensor 15 takes a value equal to the pressure in the fuel tank 9 (the pressure detected by the pressure sensor 15 will be hereinafter referred to as "tank pressure") in a steady state where the pressures in the canister 33 and in the fuel tank 9 are stable. On the other hand, the tank pressure PTANK takes a value which is different from the actual tank pressure in a transient state where the pressure in the fuel tank 9 is being reduced, for example.

The canister 33 contains active carbon for adsorbing the evaporative fuel in the fuel tank 9. The canister 33 communicates with the atmosphere through a vent passage 37.

The vent passage 37 is provided with a vent shut valve (on-off valve) 38. The vent shut valve 38 is a solenoid valve, and its operation is controlled by the ECU 5. The vent shut valve 38 is opened in refueling or during purging of evaporative fuel from the canister 33 to the intake pipe 2. Further, the vent shut valve 38 is opened and closed during execution of the abnormality diagnosis to be hereinafter described.

The purging passage 32 connected between the canister 33 and the intake pipe 2 is provided with a purge control valve 34. The purge control valve 34 is a solenoid valve whose opening degree can be continuously controlled by changing the on-off duty ratio of a control signal. The control signal of the purge control valve 34 is supplied from the ECU 5, and the operation of the purge control valve 34 is controlled by the ECU 5.

The fuel tank 9, the charging passage 31, the bypass passage 31*a*, the canister 33, the purging passage 32, the two-way valve 35, the bypass valve 36, the purge control valve 34, the vent passage 37, and the vent shut valve 38 constitutes an evaporative fuel processing system 40.

When a large amount of evaporative fuel is generated in refueling into the fuel tank 9, the two-way valve 35 opens to make the canister 33 store (trap) the evaporative fuel. In a predetermined operating condition of the engine 1, the duty control of the purge control valve 34 is performed to supply a suitable amount of evaporative fuel from the canister 33 to the intake pipe 2.

The ECU 5 includes an input circuit having various functions including a function of shaping the waveforms of input signals from the various sensors, a function of correcting the voltage levels of the input signals to a predetermined level, and a function of converting analog signal values into digital signal values, a central processing unit (which will be hereinafter referred to as "CPU"), a memory circuit preliminarily storing various operational programs to be executed by the CPU and for storing the results of computation or the like by the CPU, and an output circuit for supplying drive signals to the fuel injection valves 6, the purge control valve 34, the bypass valve 36, and the vent shut valve 38.

For example, the CPU of the ECU 5 controls the amount of fuel to be supplied to the engine 1 and the duty control of the purge control valve 34 according to output signals from the various sensors including the engine rotational speed sensor 17, the intake pipe absolute pressure sensor 13, and the engine coolant temperature sensor 18.

Figure 2:
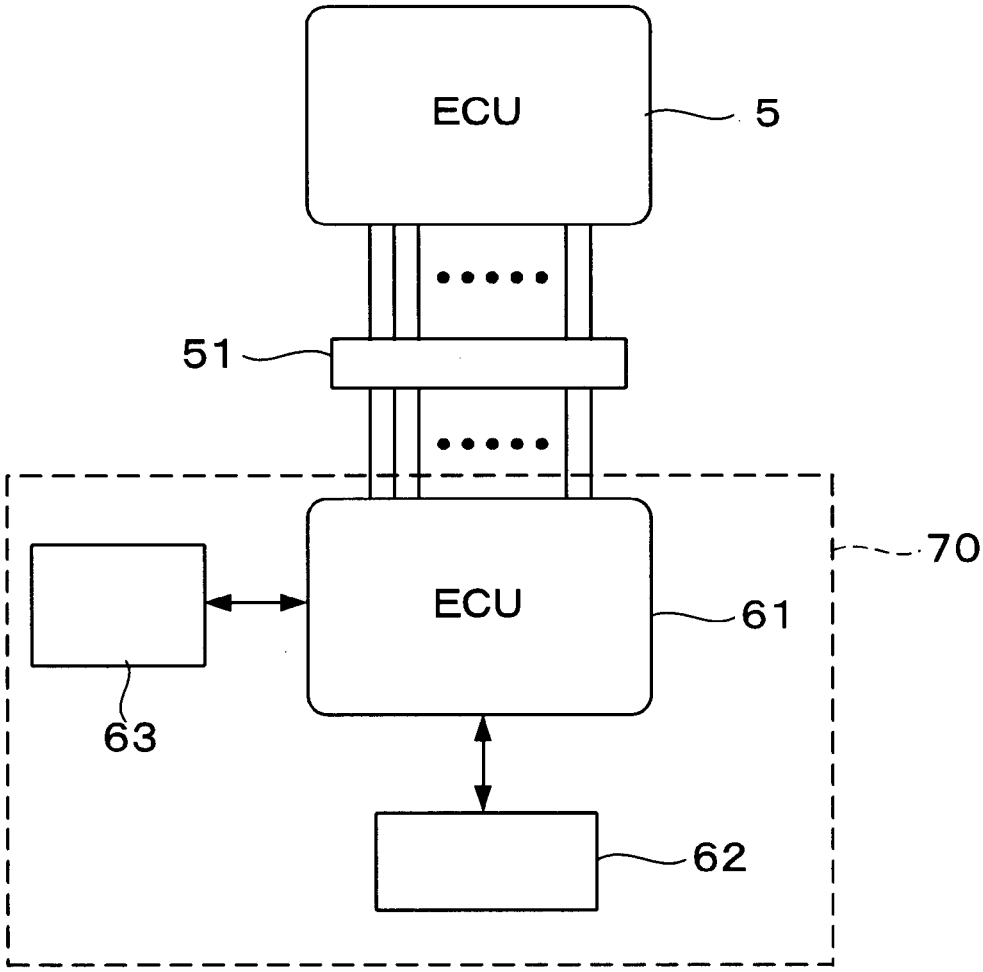
FIG. 2 is a schematic diagram showing the configuration of an external abnormality diagnosis apparatus and Illustrating the connection of the external abnormality diagnosis apparatus and the control system for the internal combustion engine shown in FIG. 1.

The ECU 5 is connected to a connector 51. As shown in FIG. 2, the ECU 5 is connectable through the connector 51 to an external abnormality diagnosis apparatus 70. The abnormality diagnosis apparatus 70 includes an electronic control unit 61 for executing abnormality diagnosis (this control unit will be hereinafter referred to as "abnormality diagnosis ECU"), an input section 62 for inputting necessary information from an operator and instructing the ECU 5 to execute the abnormality diagnosis, and a display section 63 for displaying the result of the abnormality diagnosis. The abnormality diagnosis ECU 61 includes a central processing unit (CPU), a memory circuit preliminarily storing various operational programs to be executed by the CPU and for storing the results of computation or the like by the CPU, and an interface circuit for exchanging information between the abnormality diagnosis ECU 61 and the engine control ECU 5.

In executing the abnormality diagnosis, the abnormality diagnosis ECU 61 is connected through the connector 51 to the engine control ECU 5 to supply drive command signals for the bypass valve 36, the purge control valve 34, and the vent shut valve 38 to the engine control ECU 5. The engine control ECU 5 supplies detection signals from the various sensors to the abnormality diagnosis ECU 61. Accordingly, the abnormality diagnosis for the evaporative fuel processing system 40 can be executed by the external abnormality diagnosis apparatus 70 through the ECU 5.

Figure 3:
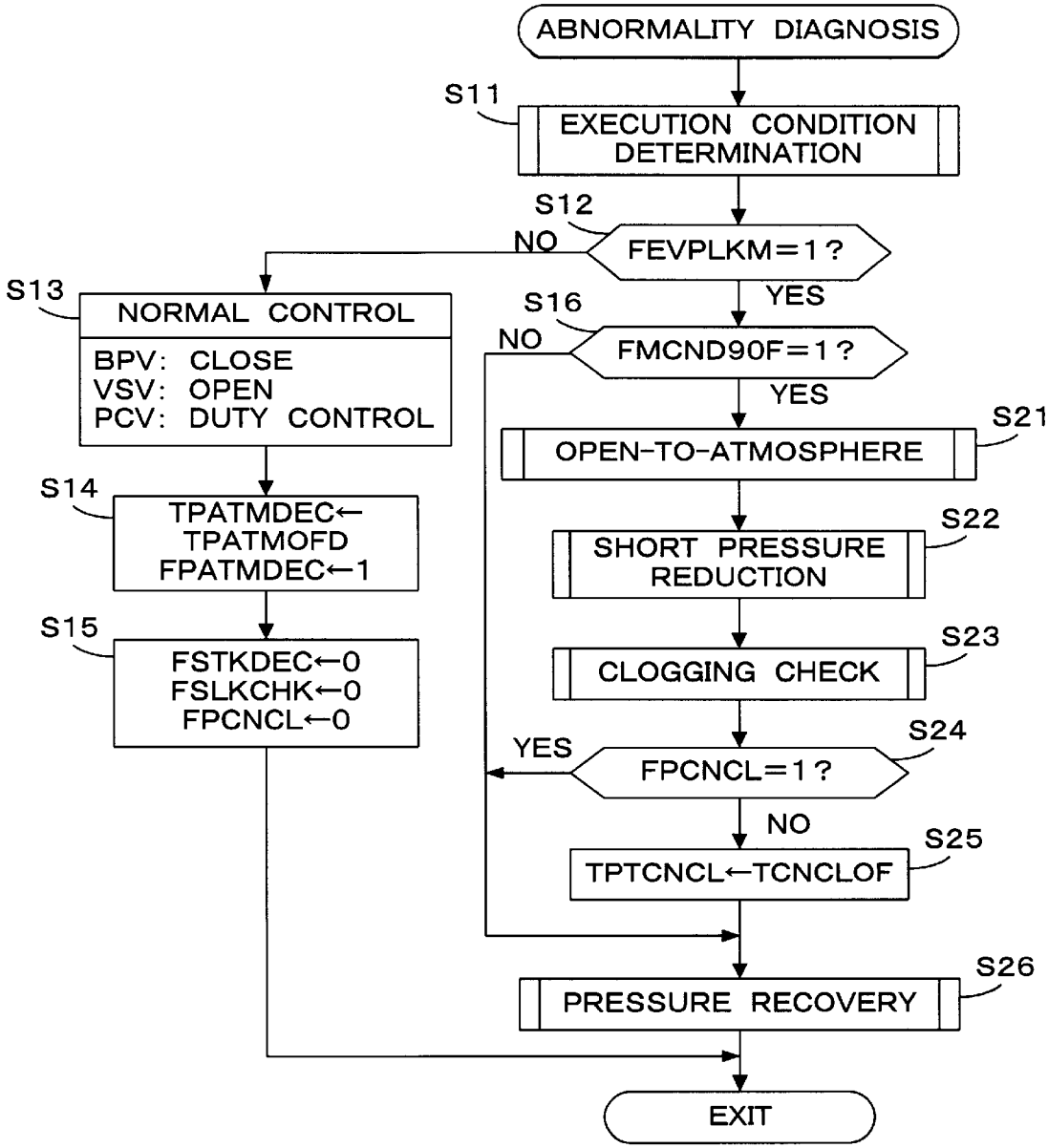
FIG. 3 is a flowchart of an abnormality diagnosis process.

FIG. 3 is a flowchart showing a program for executing the abnormality diagnosis by the external abnormality diagnosis apparatus 70. This program is executed by the CPU of the abnormality diagnosis ECU 61 at predetermined time periods (e.g., 80 msec).

Figure 4:
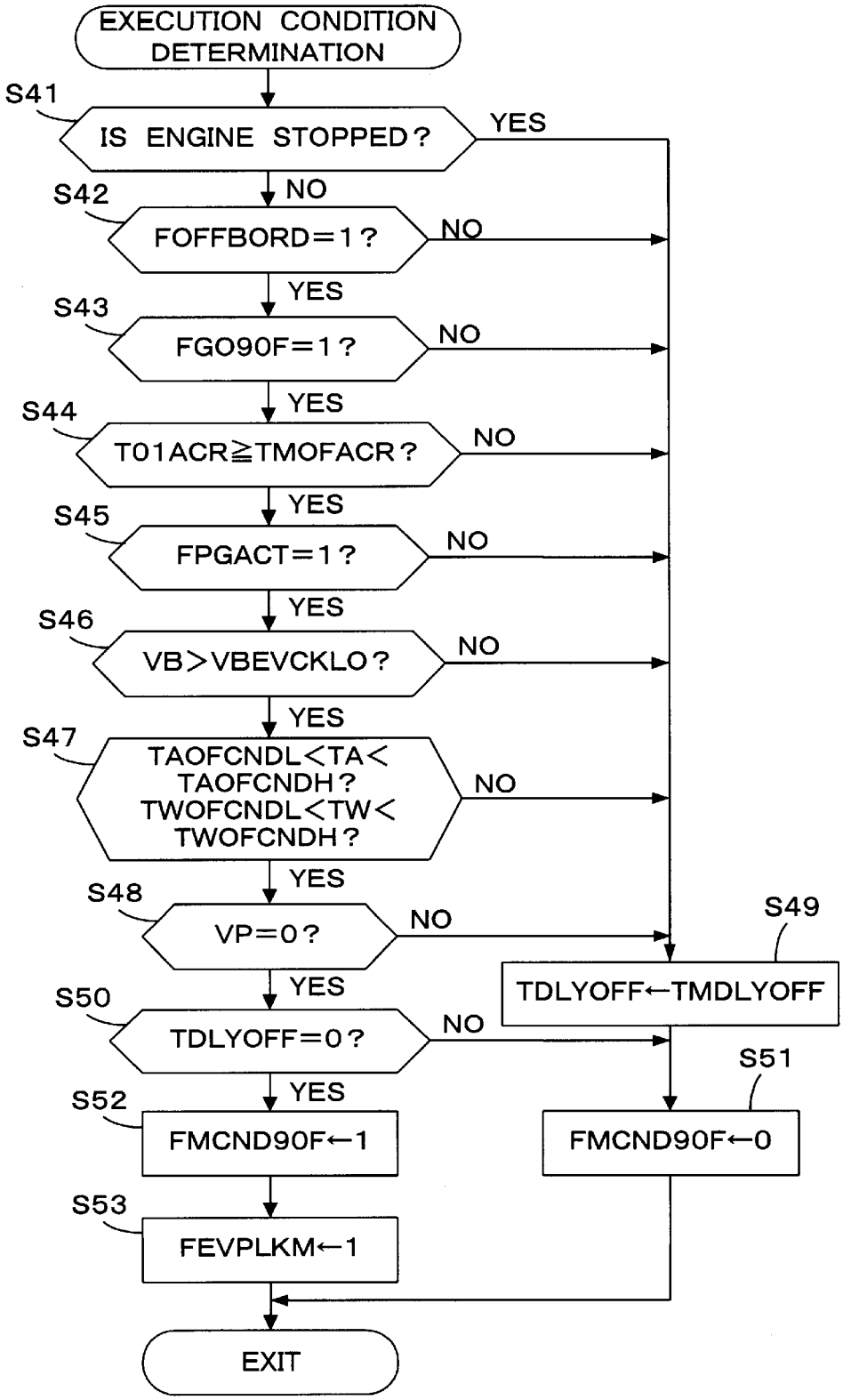
FIG. 4 is a flowchart showing a process of determining the execution condition of abnormality diagnosis.
Figure 9:
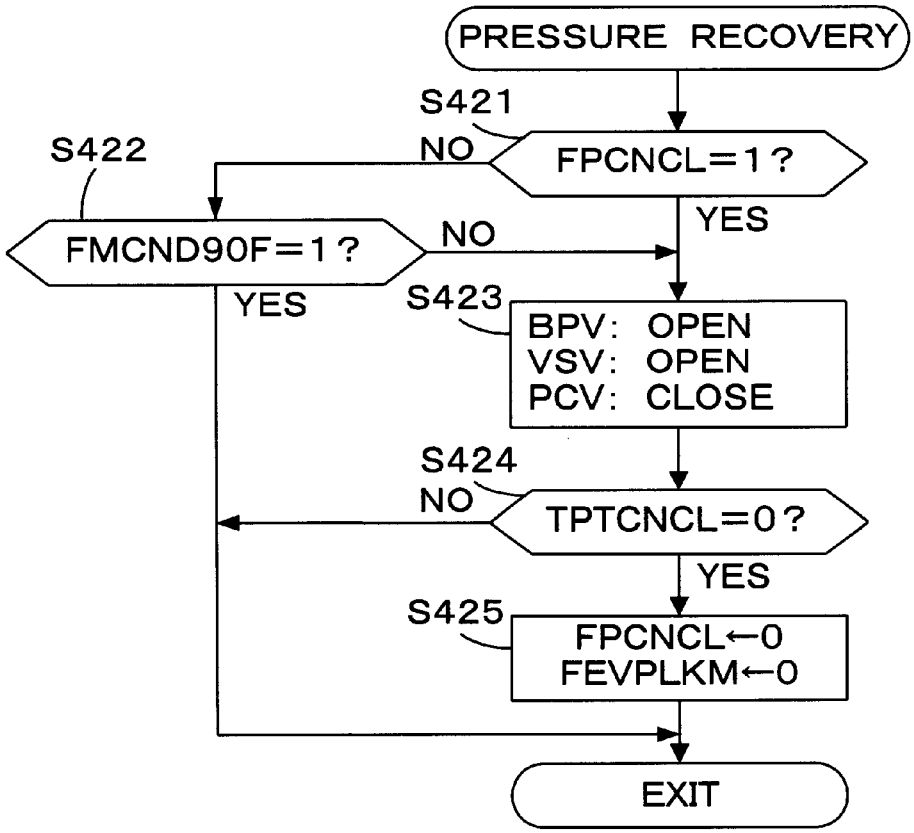
FIG. 9 is a flowchart of a pressure recovery process.

In step S11, the execution condition determination process shown in FIG. 4 is executed. When the execution condition of the abnormality diagnosis is satisfied, a monitor execution flag FEVPLKM and an execution condition flag FMCND90F are both set to "1". When the execution condition becomes dissatisfied after the execution condition is once satisfied, the execution condition flag FMCND90F is returned to "0", but the monitor execution flag FEVPLKM is maintained at "1" until the pressure recovery process shown in FIG. 9 is completed.

In step S12, it is determined whether or not the monitor execution flag FEVPLKM is "1". If FEVPLKM is "0", normal control is executed (step S13). That is, a valve closing command signal for the bypass valve (BPV) 36, a valve opening command signal for the vent shut valve (VSV) 38, and a duty control signal for the purge control valve (PCV) 34 are output. Thereafter, a downcount timer TPATMDEC, which is referred to in the open-to-atmosphere process (step S21 and FIG. 5) described below, is set to a predetermined time period TPATMOFD (e.g., 30 sec) and then started (step S14). Further in step S14, an open-to-atmosphere flag FPATMDEC is set to "1". When the open-to-atmosphere flag FPATMDEC is set to "1", the open-to-atmosphere process is executed.

Figure 6:
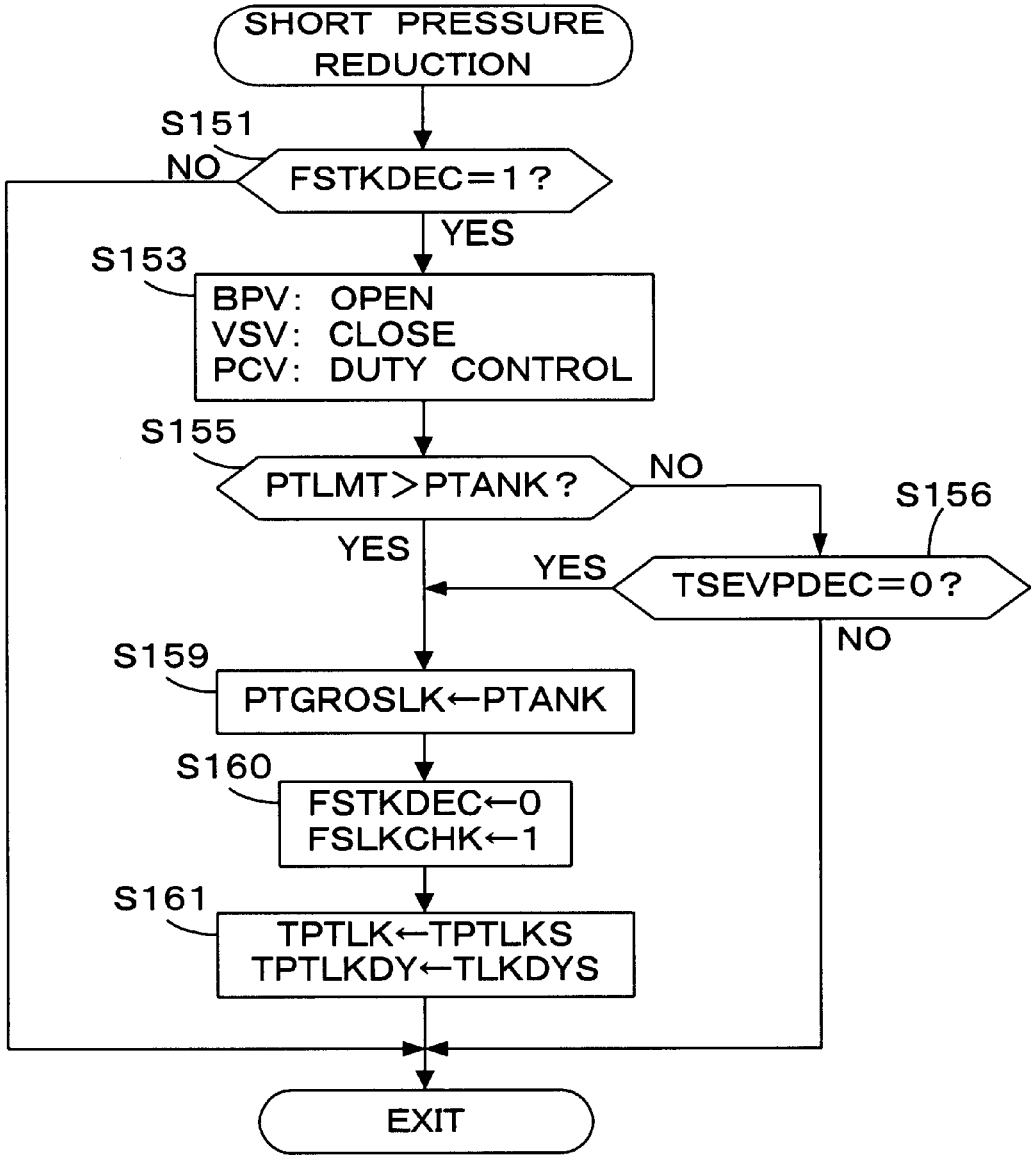
FIG. 6 is a flowchart of a short pressure reduction process.
Figure 7:
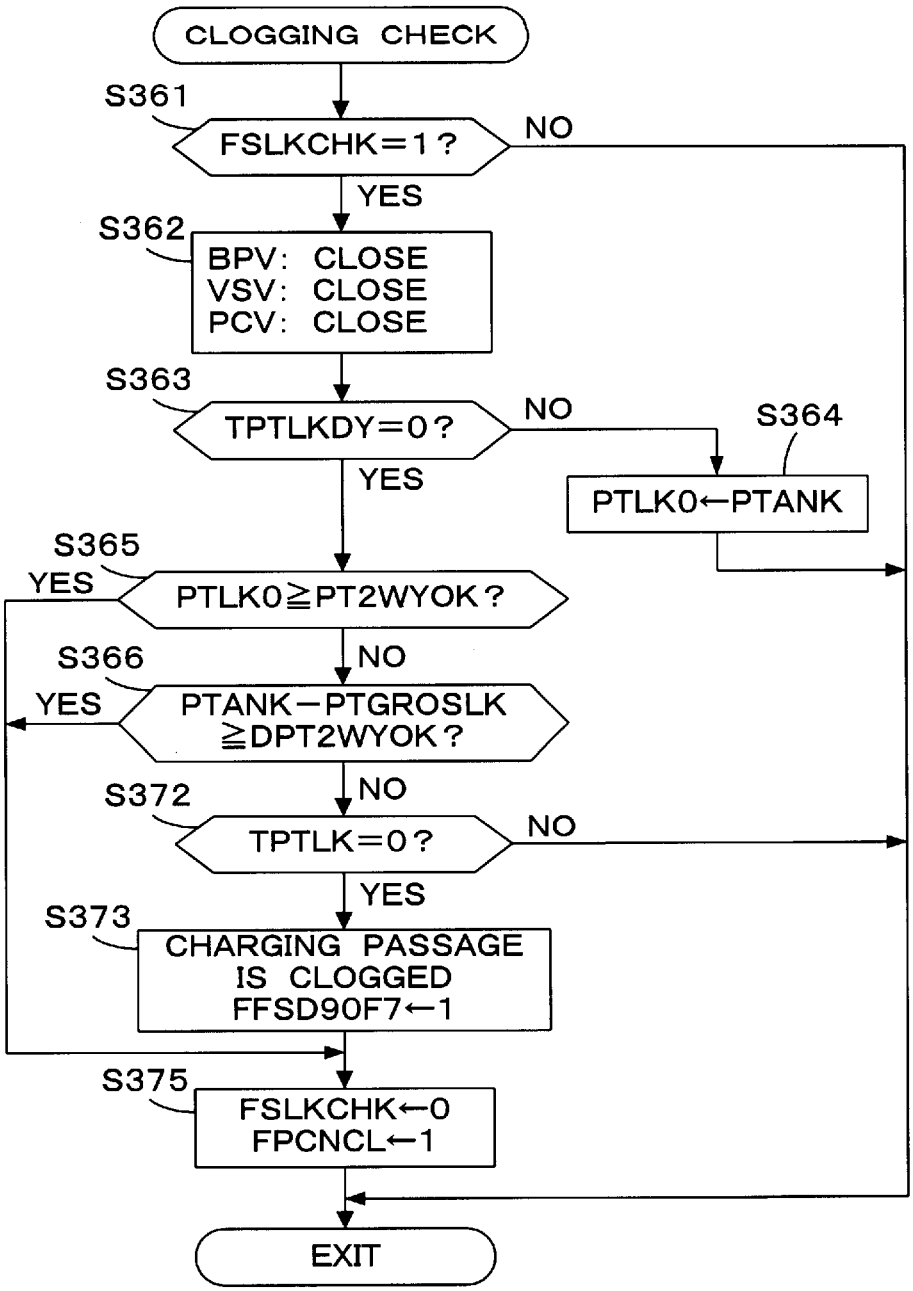
FIG. 7 is a flowchart of a clogging check process.

In step S15, a short pressure reduction flag FSTKDEC, a clogging check flag FSLKCHK, and a pressure recovery flag FPCNCL are both set to "0", and this program ends. When the short pressure reduction flag FSTKDEC is set to "1", the short pressure reduction process shown in FIG. 6 is executed. When the clogging check flag FSLKCHK is set to "1", the clogging check process shown in FIG. 7 is executed. When the pressure recovery flag FPCNCL is set to "1", the pressure recovery process shown in FIG. 9 is executed.

When the monitor execution flag FEVPLKM is set to "1", the program proceeds from step S12 to step S16, in which it is determined whether or not the execution condition flag FMCND90F is "1". Since the answer to step S16 is normally affirmative (YES), the program proceeds to step S21, in which the open-to-atmosphere process is executed. Thereafter, the short pressure reduction process shown in FIG. 6 and the clogging check process shown in FIG. 7 are executed (steps S22 and S23), and it is determined whether or not the pressure recovery flag FPCNCL is "1" (step S24). The pressure recovery flag FPCNCL is set to "1" at the time the clogging check process is completed in step S23. If the answer to step S24 is negative (NO), a downcount timer TPTCNCL, which is referred to in the pressure recovery process of step S26, is set to a predetermined time period TCNCLOF (e.g., 10 sec) and then started (step S25). Thereafter, the program proceeds to step S26. When the pressure recovery flag FPCNCL is set to "1", the program proceeds from step S24 directly to step S26.

In step S26, the pressure recovery process shown in FIG. 9 is executed. Thereafter, this program ends.

When the execution condition of the abnormality diagnosis becomes dissatisfied, the execution condition flag FMCND90F is returned to "0", but the monitor execution flag FEVPLKM is maintained at "1". Accordingly, the program proceeds from step S12 through step S16 to step S26 to execute the pressure recovery process. After completing the pressure recovery process, the monitor execution flag FEVPLKM is returned to "0" to restore the normal control.

FIG. 4 is a flowchart showing the execution condition determination process executed in step S11 shown in FIG. 3.

In step S41, it is determined whether or not the engine 1 is stopped. If the engine 1 is stopped, it is determined that the execution condition is not satisfied, and a downcount timer TDLYOFF, which is referred to in step S50, is set to a predetermined time period TMDLYOFF (e.g., 5 sec) and then started (step S49). Thereafter, the execution condition flag FMCND90F is set to "0" (step S51), and this process ends.

If the engine 1 is in operation, it is determined whether or not a diagnosis permission flag FOFFBORD is "1" (step S42). The flag FOFFBORD is set to "1" when the abnormality diagnosis by the external abnormality diagnosis apparatus 70 is permitted by another process (not shown).

If FOFFBORD is "1", it is determined whether or not a diagnosis execution command flag FGO90F is "1" (step S43). The flag FGO90F is set to "1" when the execution of the abnormality diagnosis is commanded by another process not shown.

If FGO90F is "1", it is determined whether or not the value of an upcount timer T01ACR for measuring the time after completion of starting of the engine 1 is greater than or equal to a predetermined time period TMOFACR (e.g., 10 sec) (step S44).

If T01ACR is greater than or equal to TMOFACR, it is determined whether or not a purge permission flag FPGACT is "1" (step S45). The flag FPGACT is set to "1" when it is permitted to purge the evaporative fuel stored in the canister 33 to the intake pipe 2.

If FPGACT is "1", it is determined whether or not a battery voltage VB is higher than a predetermined voltage VBEVCKLO (e.g., 8 V) (step S46). If VB is greater than VBEVCKLO, it is determined whether or not the intake air temperature TA is in a range between a predetermined upper limit TAOFCNDH (e.g., 100° C.) and a predetermined lower limit TAOFCNDL (e.g., 0° C.), and it is also determined whether or not the engine coolant temperature TW is in a range between a predetermined upper limit TWOFCNDH (e.g., 100° C.) and a predetermined lower limit TWOFCNDL (e.g., 0° C.) (step S47).

If the intake air temperature TA is in the range between TAOFCNDL and TAOFCNDH, and the engine coolant temperature TW is in the range between TWOFCNDL and TWOFCNDH, it is determined whether or not the vehicle speed VP is "0" (step S48).

If the answer to any one of steps S42 to S48 is negative (NO), it is determined that the execution condition is not satisfied, and the program proceeds to step S49. If the answers to all of steps S42 to S48 are affirmative (YES), it is determined whether or not the value of the timer TDLYOFF started in step S49 is "0" (step S50). If TDLYOFF is greater than "0", the program proceeds to step S51. If TDLYOFF is "0", it is determined that the execution condition is satisfied, so that the execution condition flag FMCND90F is set to "1" (step S52) and the monitor execution flag FEVPLKM is set to "1" (step S53). Then, this process ends.

Figure 5:
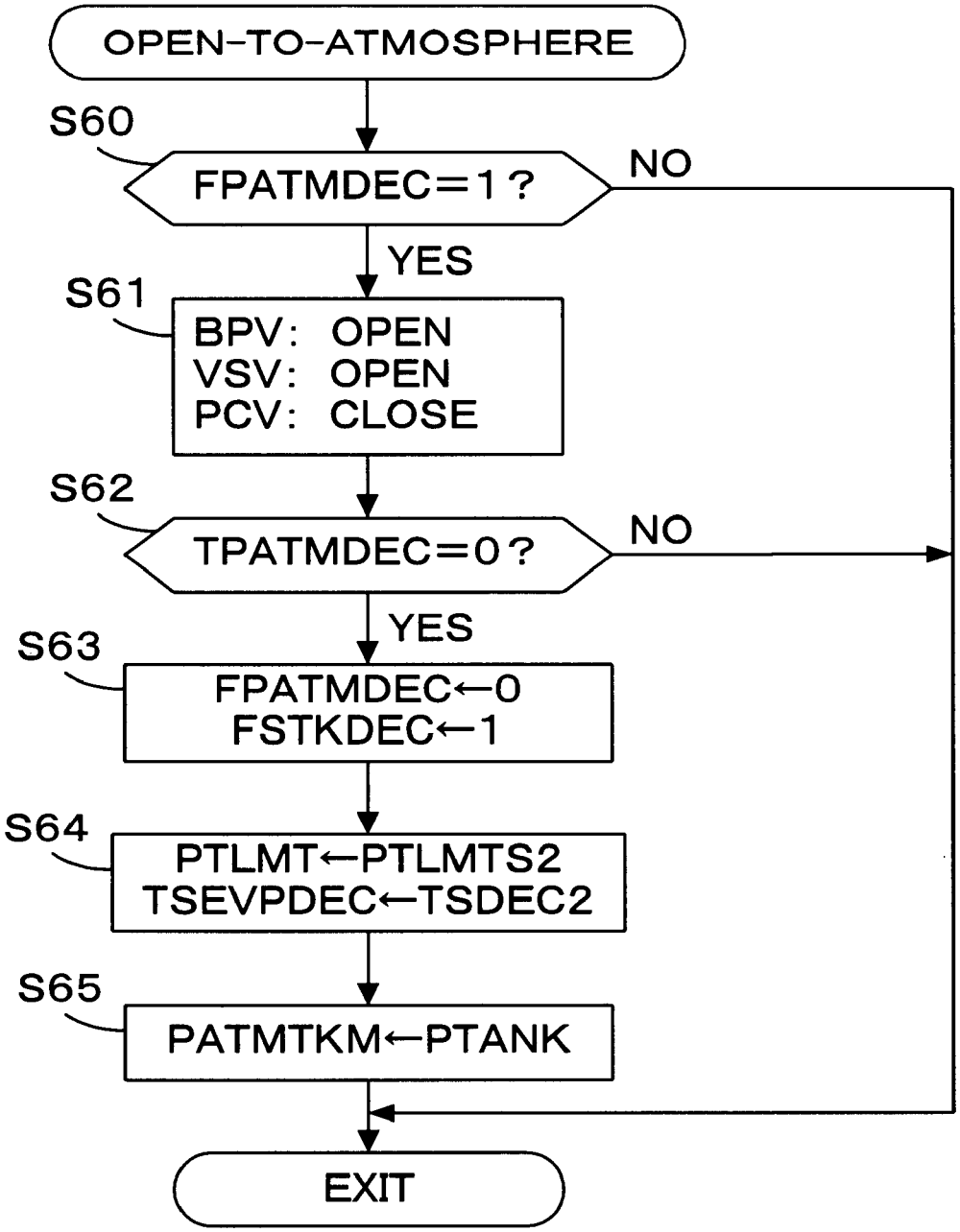
FIG. 5 is a flowchart of an open-to-atmosphere process.

FIG. 5 is a flowchart showing the open-to-atmosphere process executed in step S21 shown in FIG. 3.

In step S60, it is determined whether or not the open-to-atmosphere flag FPATMDEC is "1". Initially, the flag FPATMDEC is "1". Accordingly, the program proceeds to step S61 to output a valve opening command signal for the bypass valve 36, a valve opening command signal for the vent shut valve 38, and a valve closing command signal for the purge control valve 34. In step S62, it is determined whether or not the value of the timer TPATMDEC started in step S14 shown in FIG. 3 is "0". Initially, TPATMDEC is greater than "0", so that this process ends immediately.

If TPATMDEC is "0" in step S62, the open-to-atmosphere flag FPATMDEC is set to "0" and the short pressure reduction flag FSTKDEC is set to "1" (step S63). By setting the open-to-atmosphere flag FPATMDEC to "0", the answer to step S60 in the subsequent executions becomes negative (NO), so that the open-to-atmosphere process is not substantially executed.

In step S64, a predetermined limit pressure PTLMT, which is referred to in the short pressure reduction process, is set to a predetermined value PTLMTS2 (e.g., a pressure value which is lower than the atmospheric pressure by about 6 kPa (45 mmHg)). Further, a downcount timer TSEVPDEC, which is referred to in the short pressure reduction process, is set to a predetermined time period TSDEC2 (e.g., about 3 to 5 sec) and then started. Thereafter, a present output PTANK from the pressure sensor 15 is stored as a memory value PATMTKM (step S65), and this process ends.

FIG. 6 is a flowchart showing the short pressure reduction process executed in step S22 shown in FIG. 3.

In step S151, it is determined whether or not the short pressure reduction flag FSTKDEC is "1". If FSTKDEC is "0", this process ends immediately. That is, the short pressure reduction process is substantially executed when the short pressure reduction flag FSTKDEC is set to "1".

When the short pressure reduction flag FSTKDEC is set to "1" in step S63 shown in FIG. 5, the program proceeds from step S151 to step S153 to output a valve opening command signal for the bypass valve 36, a valve closing command signal for the vent shut valve 38, and a duty control signal (constant duty ratio) for the purge control valve 34. Accordingly, the negative pressure in the intake pipe 2 is introduced into the evaporative fuel processing system 40. Since the valve closing command signal for the vent shut valve 38 is output, the pressure in the canister 33 is reduced, and the pressures in the charging passage 31 and in the fuel tank 9 are also reduced. However, the pressure in the fuel tank 9 having a large capacity is not so reduced by the short pressure reduction executed for about 5 seconds.

In step S155, it is determined whether or not the pressure sensor output PTANK is lower than the predetermined limit pressure PTLMT. Normally, the answer to step S155 is negative (NO), so that the program proceeds to step S156 to determine whether or not the value of the downcount timer TSEVPDEC is "0". Initially, TSEVPDEC is greater than "0", this process ends immediately.

If PTANK is less than PTLMT or TSEVPDEC is "0", the program proceeds to step S159 to store the present pressure sensor output PTANK as a short pressure reduction completion pressure PTGROSLK. Thereafter, the short pressure reduction flag FSTKDEC is set to "0", and the clogging check flag FSLKCHK is set to "1" (step S160). In step S161, a first downcount timer TPTLK, which is referred to in the process of FIG. 7, is set to a first predetermined time period TPTLKS (e.g., 10 sec) and then started. Further, a second downcount timer TPTLKDY, which is referred to in the process of FIG. 7, is set to a second predetermined time period TLKDYS (e.g., 0.5 sec) and then started.

The short pressure reduction process shown in FIG. 6 is normally executed for the predetermined time period TSDEC2. This predetermined time period TSDEC2 is set to a time period during which a pressure in the charging passage 31 may be reduced to a predetermined pressure PDEC2 (e.g. a pressure which is lower than the atmospheric pressure by about 2.7 kPa (20 mmHg)) when the charging passage 31 is normal.

FIG. 7 is a flowchart showing the clogging check process executed in step S23 shown in FIG. 3.

In step S361, it is determined whether or not the clogging check flag FSLKCHK is "1". If FSLKCHK is "0", this process ends immediately. That is, when the clogging check flag FSLKCHK is set to "1", the clogging check process is substantially executed.

When the clogging check flag FSLKCHK is set to "1", the program proceeds to step S362 to output a valve closing command signal for the bypass valve 36, a valve closing command signal for the vent shut valve 38, and a valve closing command signal for the purge control valve 34. Thereafter, it is determined whether or not the value of the second downcount timer TPTLKDY is "0" (step S363). Initially, TPTLKDY is greater than "0", so that the present pressure sensor output PTANK is stored as an after-valve-closing pressure PTLK0 (step S364), and this process ends.

When the value of the second downcount timer TPTLKDY becomes "0", the program proceeds from step S363 to step S365 to determine whether or not the after-valve-closing pressure PTLK0 is greater than or equal to a predetermined pressure PT2WYOK (e.g., a pressure value lower than the atmospheric pressure by about 4.7 kPa (35 mmHg)). If the answer to step S365 is affirmative (YES), the program proceeds to step S375, in which the clogging check flag FSLKCHK is returned to "0" and the pressure recovery flag FPCNCL is set to "1". Thereafter, this process ends. When step S375 is executed, the clogging check process ends and the pressure recovery process (FIG. 9) starts.

If PTLK0 is less than PT2WYOK in step S365, it is determined whether or not a pressure change amount (PTANK−PTGROSLK) obtained by subtracting the short pressure reduction completion pressure PTGROSLK from the pressure sensor output PTANK, is greater than or equal to a predetermined change amount DPT2WYOK (e.g., 133 Pa (1 mmHg)) (step S366). If the pressure change amount (PTANK−PTGROSLK) is greater than or equal to the predetermined change amount DPT2WYOK, the program proceeds to step S375.

On the other hand, if the pressure change amount (PTANK PTGROSLK) is less than the predetermined change amount DPT2WYOK, it is determined whether or not the value of the first downcount timer TPTLK is "0" (step S372). Initially, TPTLK is greater than "0", so that this process ends immediately. If TPTLK is "0", it is determined that the charging passage 31 is clogged between the pressure sensor 15 and the fuel tank 9, and a clogging flag FFSD90F7 is set to "1" (step S373). Thereafter, the program proceeds to step S375.

Figure 8:
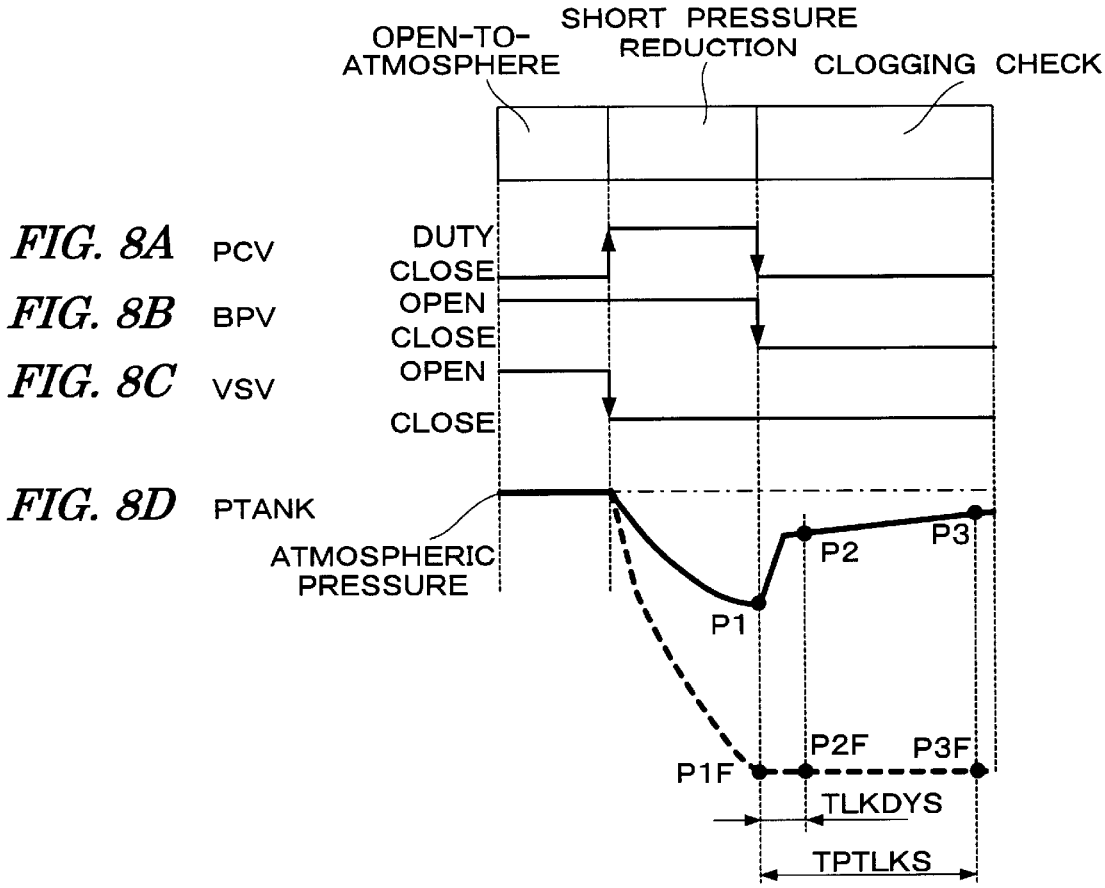
FIGS. 8A to 8D are time charts for illustrating an abnormality diagnosis method by the process of FIG. 7.

FIGS. 8A to 8D are time charts for illustrating the abnormality determination by the short pressure reduction process and the clogging check process. In FIG. 8D, the solid line shows a change in the pressure sensor output PTANK when the charging passage 31 is normal, and the broken line shows a change in the pressure sensor output PTANK when the charging passage 31 is clogged between the pressure sensor 15 and the fuel tank 9. Further, reference symbols P1, P2, and P3 in FIG. 8D respectively denote a value of the short pressure reduction completion pressure PTGROSLK, a value of the after-valve-closing pressure PTLK0, and a value of the pressure sensor output PTANK after the elapse of the first predetermined time period TPTLKS from the time of closing the bypass valve 36, when the charging passage 31 is normal. Reference symbols P1F, P2F, and P3F in FIG. 8D respectively denote a value of the short pressure reduction completion pressure PTGROSLK, a value of the after-valve-closing pressure PTLK0, and a value of the pressure sensor output PTANK after the elapse of the first predetermined time period TPTLKS from the time of closing the bypass valve 36, when the charging passage 31 is clogged.

As understood from FIGS. 8A to 8D, when the charging passage 31 normally (properly) communicates with the fuel tank 9 having a large capacity, the short pressure reduction completion pressure P1 is not so reduced. Further, since the pressure in the fuel tank 9 upon completion of the pressure reduction is higher than the pressure sensor output PTANK, the after-valve-closing pressure P2 is higher than the short pressure reduction completion pressure P1 when the charging passage 31 is normal. In contrast, when the charging passage 31 is clogged, the charging passage 31 does not normally (properly) communicate with the fuel tank 9, so that the short pressure reduction completion pressure P1F is considerably lower than the normal pressure P1. Further, even after closing the bypass valve 36, the pressure sensor output PTANK is not influenced by the pressure in the fuel tank 9 due to the clogging of the charging passage 31. Therefore, the after-valve-closing pressure P2F is substantially the same as the short pressure reduction completion pressure P1 F. Accordingly, in the normal condition of the charging passage 31, the answer to step S365 becomes affirmative (YES), and in the clogged condition of the charging passage 31, the answer to step S365 becomes negative (NO). Even when the answer to step S365 becomes negative (NO) in the normal condition, the answer to step S366 becomes affirmative (YES) because the pressure P3 is considerably higher than the short pressure reduction completion pressure P1. In contrast, the pressure P3F in the clogged condition is substantially the same as the short pressure reduction completion pressure P1F (i.e., there is almost no change in the pressure sensor output PTANK over the first predetermined time period TPTLKS). That is, the condition where the answer to step S366 is negative (NO) ((PTANK−PTGROSLK)<DPT2WYOK) continues over the first predetermined time period TPTLKS, and it is determined that the charging passage 31 is clogged.

FIG. 9 is a flowchart showing the pressure recovery process executed in step S26 shown in FIG. 3.

In step S421, it is determined whether or not the pressure recovery flag FPCNCL is "1". If FPCNCL is "0", it is determined whether or not the execution condition flag FMCND90F is "1". If FMCND90F=1, which indicates that the execution condition of the abnormality diagnosis is satisfied, this process ends immediately. On the other hand, if the pressure recovery flag FPCNCL is "1" or the execution condition is not satisfied (FMCND90F=0), the program proceeds to step S423 to output a valve opening command signal for the bypass valve 36, a valve opening command signal for the vent shut valve 38, and a valve closing command signal for the purge control valve 34.

Thereafter, it is determined whether or not the value of the timer TPTCNCL started in step S25 shown in FIG. 3 is "0" (step S424). Initially, TPTCNCL is greater than "0", so that this process ends immediately. If TPTCNCL is "0", both the pressure recovery flag FPCNCL and the monitor execution flag FEVPLKM are returned to "10" (step S425). As a result, the program of FIG. 3 proceeds from step S12 to step S13 to restore the normal control.

According to this preferred embodiment as mentioned above, the short pressure reduction process for reducing the pressure in the canister 33 to a pressure lower than the atmospheric pressure is executed for a relatively short time period (about 3 to 5 sec) in the condition where the bypass valve 36 is open, and when the amount of change in pressure detected by the pressure sensor 15 (PTANK−PTGROSLK) is less than the predetermined change amount DPT2WYOK after ending this pressure reduction, it is determined that the charging passage 31 is clogged between the pressure sensor 15 and the fuel tank 9. Accordingly, the clogging of the charging passage 31 can be easily detected.

In this preferred embodiment, the bypass valve 36 corresponds to the on-off valve. Further, the engine 1, the intake pipe 2, the purging passage 32, the purge control valve 34, the ECU 5, and the ECU 61 constitute the pressure reducing means, and the ECU 61 constitutes the clogging determining means. More specifically, step S63 in FIG. 5 and steps S153 and S156 in FIG. 6 correspond to a part of the pressure reducing means, and steps S362 to S373 in FIG. 7 correspond to the clogging determining means.

It should be noted that the present invention is not limited to the above preferred embodiment, but various modifications may be made. For example, in the above preferred embodiment, the charging passage 31 is determined to be clogged when the answers to steps S365 and S366 in FIG. 7 are both negative (NO). Alternatively, step S365 may be eliminated and it may be determined that the charging passage 31 is clogged when the pressure change amount (PTANK−PTGROSLK) is less than the predetermined change amount DPT2WYOK.

Further, the determination of clogging of the charging passage 31 by the short pressure reduction process and the clogging check process is preferably executed after confirming that a valve opening failure of the bypass valve 36 has not occurred. The valve opening failure of the bypass valve 36 is a failure such that the bypass valve 36 remains open and does not close although a valve closing command signal is supplied to the bypass valve 36. The reason for this confirmation is to prevent improper determination as follows: if the bypass valve 36 does not close when a valve closing command signal for the bypass valve 36 is supplied after completion of the short pressure reduction, the charging passage 31 may improperly be determined to be clogged although the charging passage 31 is actually unclogged.

The normality of the bypass valve 36 may be confirmed in the following manner. After executing a process similar to the open-to-atmosphere process shown in FIG. 5 to make the pressure in the evaporative fuel processing system equal to the atmospheric pressure, the pressure in the canister 33 is reduced to a pressure lower than the atmospheric pressure in the condition where a valve closing command signal for the bypass valve 36 is being output. If the difference (PATMTKM−PTANK) between the pressure PTANK detected by the pressure sensor 15 and the pressure sensor output value PATMTKM upon completion of the open-to-atmosphere process (PATMTKM is substantially equal to the atmospheric pressure) is less than a predetermined pressure difference DBPSOPN during execution of the above pressure reduction process, it can be determined that the valve opening failure of the bypass valve 36 has not occurred. This determination is based on the following: if the valve opening failure of the bypass valve 36 has occurred, the pressure sensor output PTANK is reduced in the pressure reduction process, so that the pressure difference (PATMTKM−PTANK) becomes large.

Further, in the above preferred embodiment, the two-way valve 35 is provided in the charging passage 31 and the bypass valve 36 is provided in the bypass passage 31*a* bypassing the two-way valve 35. Alternatively, only an electromagnetic on-off valve similar to the bypass valve 36 may be provided in the charging passage 31 in place of the two-way valve 35. With this configuration, the duty control of the purge control valve 34 is performed in the condition where the electromagnetic on-off valve provided in the charging passage 31 is open and the vent shut valve 38 is closed, thereby introducing the negative pressure into the canister 33. further, the abnormality diagnosis (the determination of clogging of the charging passage 31) is executed according to the pressure sensor output PTANK at the time of subsequently closing the on-off valve, by a method similar to that of the above preferred embodiment.

Further, the above-mentioned abnormality diagnosis method is applicable also to an evaporative fuel processing system having two bypass passages bypassing a two-way valve, wherein each bypass passage is provided with an electromagnetic on-off valve as described in Japanese Patent No. 2857656. With this configuration, the pressure in the canister is reduced in the condition where at least one of the two electromagnetic on-off valves (bypass valve and puff-loss valve) is open, and the at least one on-off valve in the open condition is closed after completion of the pressure reduction. When the amount of change in the pressure sensor output after closing the on-off valve is less than the predetermined pressure change amount, it is determined that the charging passage 31 is clogged between the pressure sensor 15 and the fuel tank 9.

Further, the abnormality diagnosis process (FIG. 3) may be executed by the CPU of the ECU 5 without using the external abnormality diagnosis apparatus 70.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An abnormality detecting device for an evaporative fuel processing system including:

a fuel tank;

a canister for trapping evaporative fuel generated in said fuel tank;

a charging passage for connecting said fuel tank and said canister;

an on-off valve provided in said charging passage for opening and closing said charging passage; and a pressure sensor provided in said charging passage at a position between said on-off valve and said fuel tank, said abnormality detecting device comprising:

pressure reducing means for reducing a pressure in said canister to a pressure which is lower than the atmospheric pressure in the condition where said on-off valve is open; and clogging determining means for closing said on-off valve at the time of completion of the pressure reduction by said pressure reducing means, and for determining that said charging passage is clogged between said pressure sensor and said fuel tank, wherein said clogging determining means determines that said charging passage is clogged between said pressure sensor and said fuel tank after closing said on-off valve.

2. An abnormality detecting device according to claim 1, wherein said pressure reducing means completes the pressure reduction in a short time period so that a pressure in said charging passage may be reduced to a predetermined pressure which is lower than the atmospheric pressure.

3. An abnormality detecting device according to claim 1, wherein said clogging determining means executes the determination of clogging of said charging passage after confirming no occurrence of a failure that said on-off valve remains open and does not close in spite of being supplied with a valve closing command signal.

4. An abnormality detecting device according to claim 1, wherein said clogging determining means determines that said charging passage is clogged between said pressure sensor and said fuel tank, when the condition where the amount of change in the pressure detected by said pressure sensor is less than the predetermined change amount, continues over a predetermined time period or more.

5. An abnormality detecting device according to claim 1, wherein said clogging determining means determines that said charging passage is clogged between said pressure sensor and said fuel tank, when the pressure detected by said pressure sensor after closing said on-off valve is lower than a predetermined pressure which is lower than the atmospheric pressure, and the amount of change in the pressure detected by said pressure sensor is less than said predetermined change amount.

6. An abnormality detecting device for an evaporative fuel processing system including:

a fuel tank;

a canister for trapping evaporative fuel generated in said fuel tank;

a charging passage for connecting said fuel tank and said canister;

an on-off valve provided in said charging passage for opening and closing said charging passage; and a pressure sensor provided in said charging passage at a position between said on-off valve and said fuel tank, said abnormality detecting device comprising:

a pressure reducing module for reducing a pressure in said canister to a pressure which is lower than the atmospheric pressure in the condition where said on-off valve is open; and a clogging determining module closing said on-off valve at the time of completion of the pressure reduction by said pressure reducing module, and determining that said charging passage is clogged between said pressure sensor and said fuel tank, when an amount of change in pressure detected by said pressure sensor is less than a predetermined change amount after closing said on-off valve.

7. An abnormality detecting device according to claim 6, wherein said pressure reducing module completes the pressure reduction in a short time period so that a pressure in said charging passage may be reduced to a predetermined pressure which is lower than the atmospheric pressure.

8. An abnormality detecting device according to claim 6, wherein said clogging determining module executes the determination of clogging of said charging passage after confirming no occurrence of a failure that said on-off valve remains open and does not close in spite of being supplied with a valve closing command signal.

9. An abnormality detecting device according to claim 6, wherein said clogging determining module determines that said charging passage is clogged between said pressure sensor and said fuel tank, when the condition where the amount of change in the pressure detected by said pressure sensor is less than the predetermined change amount, continues over a predetermined time period or more.

10. An abnormality detecting device according to claim 6, wherein said clogging determining module determines that said charging passage is clogged between said pressure sensor and said fuel tank, when the pressure detected by said pressure sensor after closing said on-off valve is lower than a predetermined pressure lower than the atmospheric pressure, and the amount of change in the pressure detected by said pressure sensor is less than said predetermined change amount.

11. A computer program for causing a computer to carry out an abnormality detecting method for an evaporative fuel processing system including:

a fuel tank;

a canister for trapping evaporative fuel generated in said fuel tank;

a charging passage for connecting said fuel tank and said canister;

an on-off valve provided in said charging passage for opening and closing said charging passage; and a pressure sensor provided in said charging passage at a position between said on-off valve and said fuel tank, said abnormality detecting method comprising the steps of:

a) reducing a pressure in said canister to a pressure which is lower than the atmospheric pressure in the condition where said on-off valve is open;

b) closing said on-off valve at the time of completion of the pressure reduction;

c) detecting a pressure by said pressure sensor: and d) determining that said charging passage is clogged between said pressure sensor and said fuel tank, when an amount of change in pressure detected by said pressure sensor is less than a predetermined change amount after closing said on-off valve.

12. A computer program according to claim 11, wherein the pressure reduction is completed in a short time period so that a pressure in said charging passage may be reduced to a predetermined pressure which is lower than the atmospheric pressure.

13. A computer program according to claim 11, wherein the determination of clogging of said charging passage is executed after confirming no occurrence of a failure that said on-off valve remains open and does not close in spite of being supplied with a valve closing command signal.

14. A computer program according to claim 11, wherein it is determined that said charging passage is clogged between said pressure sensor and said fuel tank, when the condition where the amount of change in the pressure detected by said pressure sensor is less than the predetermined change amount, continues over a predetermined time period or more.

15. A computer program according to claim 11, wherein it is determined that said charging passage is clogged between said pressure sensor and said fuel tank, when the pressure detected by said pressure sensor after closing said on-off valve is lower than a predetermined pressure lower than the atmospheric pressure, and the amount of change in the pressure detected by said pressure sensor is less than said predetermined change amount.

* * * * *